US005572772A

United States Patent [19]

Morita

[11] Patent Number: 5,572,772

[45] Date of Patent: Nov. 12, 1996

[54] MAGNETIC FASTENER

[75] Inventor: Tamao Morita, Tokyo, Japan

[73] Assignee: Tarmo Co., Ltd., Tokyo, Japan

[21] Appl. No.: 365,388

[22] Filed: Dec. 28, 1994

[30] Foreign Application Priority Data

Dec. 28, 1993 [JP] Japan ..... 5-349386

[51] Int. Cl.[6] ..... A44B 21/00

[52] U.S. Cl. ..... 24/303

[58] Field of Search ..... 24/303, 49 M, 24/658; 292/251.5; 335/285

[56] References Cited

U.S. PATENT DOCUMENTS 3,364,532 1/1968 Hatfield ..... 24/658

5,199,138 4/1993 Monta ..... 24/303

*Primary Examiner*—James R. Brittain

*Attorney, Agent, or Firm*—Pennie & Edmonds

[57] ABSTRACT

A fastener comprising a male member (A) and a female member (B), wherein a projection (P) including a magnet is disposed on the male member and the female member defines an opening adapted to receive the projection. A slidable engagement member (60), which includes a ferromagnetic portion (61) and a non-magnetic or weakly magnetic portion (62), is disposed within the female member and is slidable relative thereto. The engagement member is positioned such that after the male member is inserted into the female member the attraction between the ferromagnetic portion and the magnet moves the engagement member into a locking relationship with the male member.

7 Claims, 7 Drawing Sheets

MAGNETIC FASTENER

BACKGROUND OF THE INVENTION

1. Field of the Invention

The present invention relates to a fastener means comprising a male fastener which is provided with a permanent magnet and a female fastener which includes an engagement means to be attracted to the permanent magnet of the male fastener when the male fastener is inserted into the female fastener, the engagement means being adapted to become engaged with said male fastener when it is attracted by the permanent magnet, and more particularly to a fastener means wherein a portion on one side of the engagement means is made of non-magnetic or weakly magnetic material.

2. Prior Art

Fastener means comprising a male fastener with a permanent magnet and a female fastener provided with a ferromagnetic slide plate which engages with a projection on the male fastener are used for various purposes, such as for backpacks to fasten the cover to the body or in shoulder bags to keep the cover closed.

Fastener means of this type have been proposed in a number of patent applications such as Japanese Patent Application (JPA) No. Sho57-128,762, JPA Hei3-244,067, JPA Hei3-246,466, JPA Hei4-177,725 and JPA Hei4-180,407. These fastener means are characterized in that by merely inserting a projection provided on the male fastener into the female fastener, a slide plate provided on the female fastener is attracted by the permanent magnet on the male fastener and easily secures engagement of the male and the female fasteners. In this type of fastener means, however, the slide plate in the female fastener to be magnetically attracted and become engaged with the projection on the male fastener is made of a ferromagnetic material shaped substantially as a square with a square hole, into which the projection of the male fastener is inserted.

In order to conveniently and firmly attract and engage the slide plate on the female fastener with the permanent magnet provided at the projection of the male fastener, it is necessary to provide a hole on the slide plate at a position slightly closer to the projection. Normally, the opposite side of the slide plate is disposed at a distance from the projection.

For this purpose, the slide plate is usually shaped like a frame with a large opening. This results in a slide plate which is considerably larger as relative to the size of the projection of the male fastener to be inserted, making it difficult to reduce the size of the female fastener.

Another defect of this particular construction of the slide plate is that the plate tends to become fragile and fails to slide stably inside the female fastener. Moreover, the frame-shaped slide plate constitutes a magnetic path even on the side where it is not magnetically attracted. This leads to a magnetic leakage and reduces the force of the projection to attract the slide plate for the amount corresponding to that leakage. Additional disadvantage is that a magnetic circuit for the permanent magnet is formed at a portion where the slide plate is manipulated.

OBJECTS OF THE INVENTION

The present invention is proposed to overcome these defects encountered in the conventional fastener means.

A main object of the present invention is therefore to provide a fastener means wherein the female fastener is made relatively compact compared to the projection of the male fastener. In other words, the present invention is characterized in that the engagement means of the female fastener which is attracted to and becomes engaged with the projection of the male fastener comprises a portion to be attracted by the projection of the male fastener which is made of a ferromagnetic material, and a portion not to be attracted by the projection of the male fastener which is made of a non-magnetic material or a weakly magnetic material, so that the space in the engagement means where the projection of the male fastener is inserted can be made smaller to thereby reduce the overall size of the engagement means and to eventually reduce the size of the female fastener comprising this engagement means.

Another main object of the present invention is to provide a fastener means which is characterized in that the engagement means of the female fastener is so constructed that it is manipulated at a portion where it is made of a non-magnetic or weakly magnetic material, to thereby prevent magnetic leakage therefrom.

Still another object of the present invention is to provide a fastener means which is characterized in that the engagement means of the female fastener attracted by the male fastener includes a ferromagnetic portion which is attracted by the male fastener and a non-magnetic or weakly magnetic portion opposite to said first portion, so that attraction of the female fastener to the permanent magnet provided in the male fastener can be effected.

These and other objects of the present invention will become apparent from the detailed description below.

SUMMARY OF THE INVENTION

In order to achieve the above mentioned objects, the present invention fastener means comprises a male fastener A having a projection P to be removably inserted in a female fastener B, which in turn includes a movable engagement means 60 to be engaged with the projection P. The projection P comprises a permanent magnet M or is provided with a permanent magnet M. The engagement means 60 includes a portion 61 made of a ferromagnetic material and a portion 62 made of a non-magnetic or weakly magnetic material. The projection P includes a retaining portion R to which the ferromagnetic material 61 of the engagement means 60 is attracted to thereby prevent the projection P from slipping out. A manipulation lobe 62*a* is provided on the portion 62 made of a non-magnetic or weakly magnetic material and disposed on the side opposite to the retaining portion R. The manipulation lobe 62*a* causes the engagement means 60 to move in the direction in which the engagement means 60 is relieved of its engagement with the male member A.

With the fastener means according to the present invention having the above mentioned construction, said projection P of the male fastener A to be inserted in the engagement means 60 of the female fastener B is conveniently attracted to the ferromagnetic portion 61 of the means 60 when the projection P is brought near the engagement means on whichever side, since the portion to be attracted to the retaining portion R of the projection P is made of a ferromagnetic material, while the portion 62 opposite this portion 61 is made of a non-magnetic or weakly magnetic material.

As the manipulation lobe 62*a* of the engagement means 60 is provided on the portion 62 made of a non-magnetic or weakly magnetic material, magnetism of the permanent magnet M provided on the male fastener A is prevented from leaking outside. Moreover, there is formed no magnetic path of the permanent magnet M on the manipulation lobe 62*a*.

BRIEF DESCRIPTION OF THE DRAWINGS

FIGS. 1 through 7 show the first embodiment of the fastener means, wherein:

FIG. 1 is a perspective exploded view to show the component parts of the first embodiment fastener means.

FIG. 2 is a perspective bottom view to show each of the component parts of the male fastener A.

FIG. 3 is a perspective top view to show each of the component parts of the male fastener A to which some of the component parts of the female fastener B are attached.

FIG. 4 and 5 show the fastener means according to the first embodiment when it is used. FIG. 4 is a sectional view wherein the engagement between the fasteners A and B is released as the engagement means 60 is pressed inside the main body 70 of the female fastener when the projection P is inserted in the female fastener B. FIG. 5 is a sectional view wherein the engagement means 60 of the female member B is attracted to the projection P of the male fastener A when the projection P is inserted in the female fastener A.

FIGS. 6 and 7 are the top plan views wherein the engagement means 60 is housed inside a first housing means 71 of the female fastener B; in FIG. 6 the engagement means 60 is pressed inside the female fastener B, and in FIG. 7 the manipulation lobe 62*a* projects outside the main body 70 of the female fastener B as the engagement means 60 is attracted to the male fastener A as shown in FIG. 5.

FIG. 8 is a sectional view wherein the projection P is inserted in the female fastener B and the engagement means 60 is pressed inside the main body 70 of the female fastener B.

FIG. 9 is a perspective view to show a leg member 70 of the male fastener A to be used for fixing. FIG. 10 is a sectional view wherein the engagement means 60 is attracted to and engaged with the projection P inserted in the female fastener B.

DETAILED DESCRIPTION OF THE INVENTION

Figure 1:
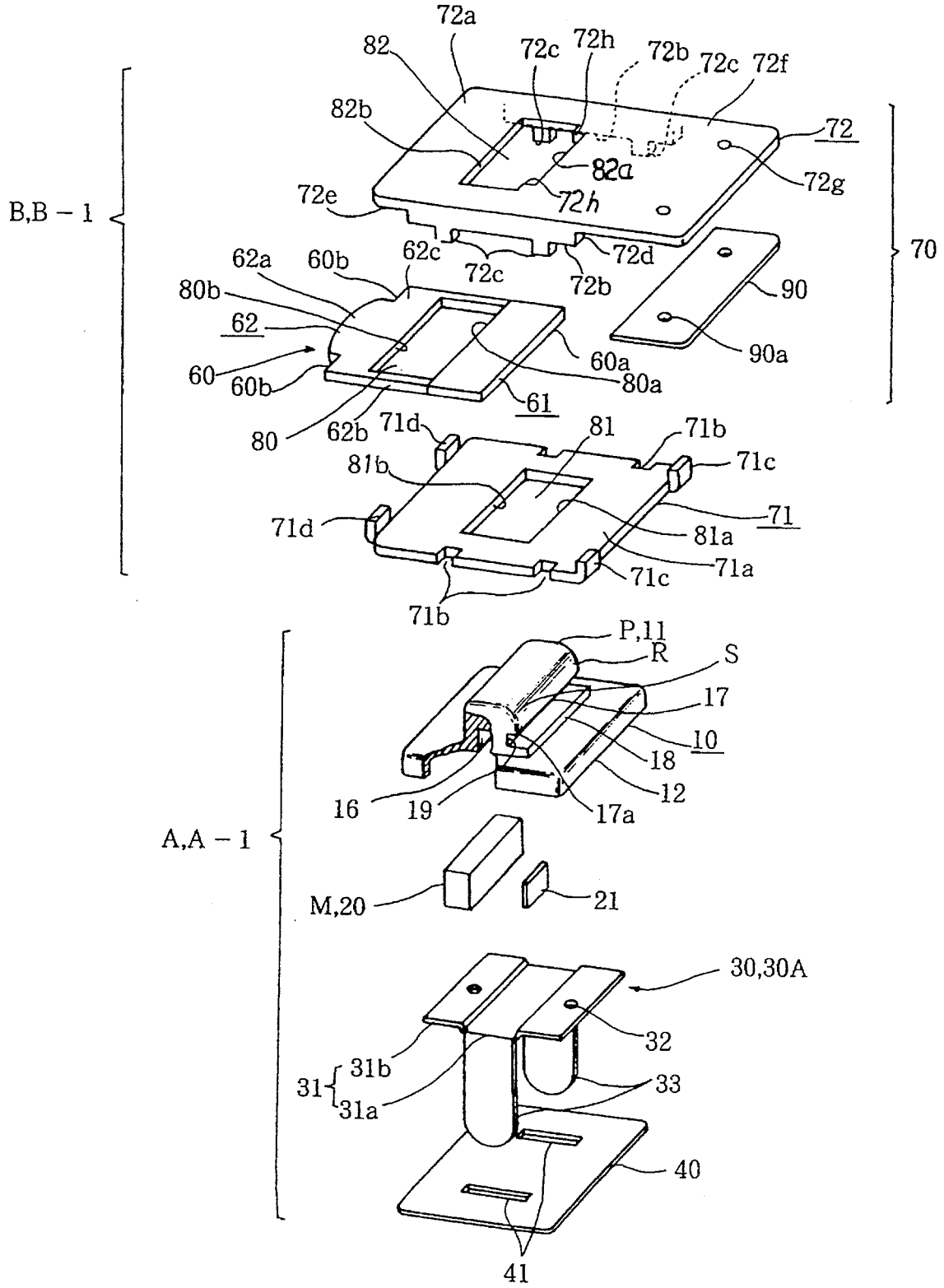
Figure 2:
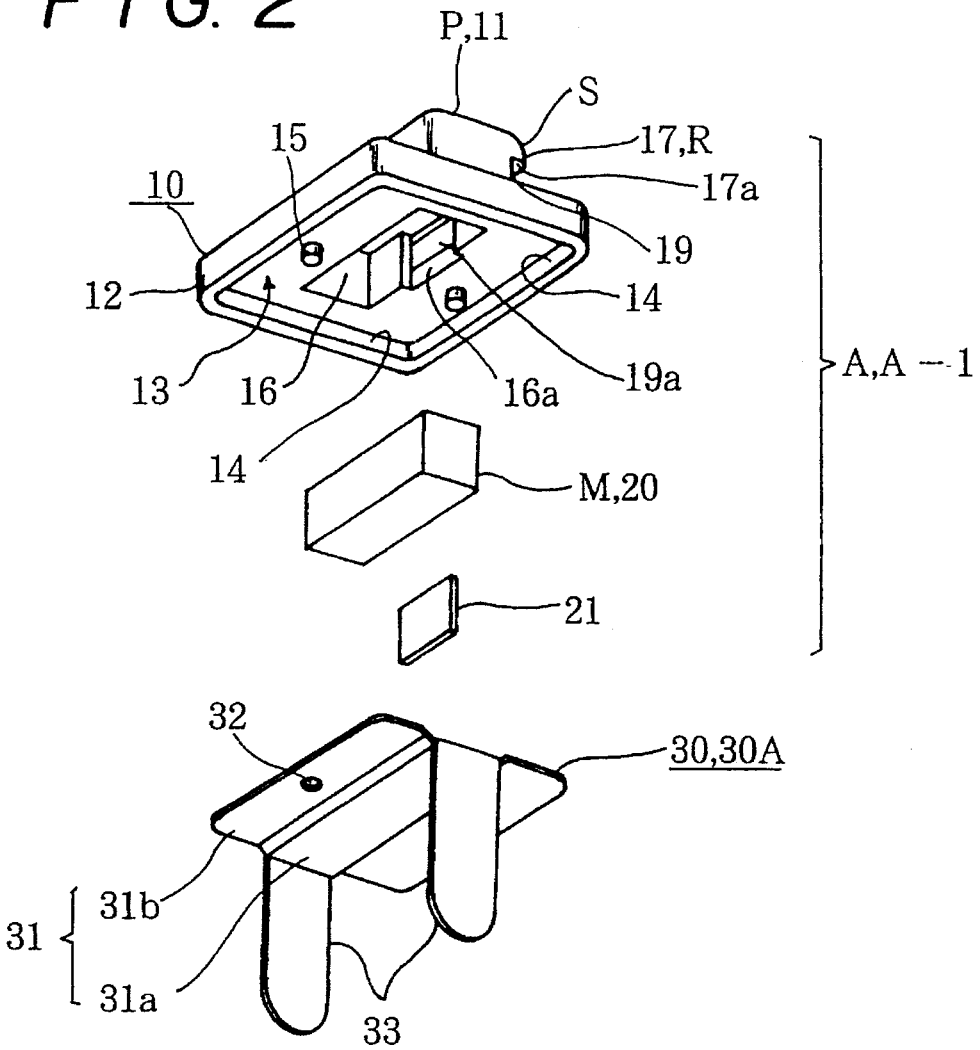

Typical embodiments and specific examples of the present invention will now be described in more detail. In the following description, identical or substantially identical component parts will be given the same reference numbers in each of the drawings and repeated explanation is omitted.

The embodiments and specific examples described below are given merely for illustrative purposes and the present invention is in no way limited by them.

First, an outline of the fastener means according to the present invention will be explained. The fastener means according to the present invention comprises a male fastener A which is fixed to a first object 110 and a female fastener B which is fixed to the edge of a second object 120.

The male fastener A to be attached to the first object 110 is provided with a projection P made of a permanent magnet M (referred to as the main male body 50 in the corresponding embodiments described below) or a projection P having a permanent magnet M (referred to as the permanent magnet 20 in the corresponding embodiments below).

The female fastener B comprises a plate-like engagement means 60 which is attracted to the permanent magnet M of the male fastener A. The engagement means 60 includes a ferromagnetic portion 61 disposed at least on one side of the engagement means 60 where it is attracted by the permanent magnet M, or on the side corresponding to the retaining portion R of the projection P. The portion 62 of the engagement means 60 on the side opposite to said retaining portion R of the projection P is made of a non-magnetic or weakly magnetic material, where a manipulation lobe 62*a* is provided.

Thus, the projection P of the male fastener A fixed on the first object 110 becomes engaged with the female fastener B attached to the second object 120 as the main body of the male fastener A is brought in contact with or near the female fastener B to insert the projection P into the female fastener B from one end thereof toward the other end.

As the projection P of the male fastener A becomes engaged with the ferromagnetic portion 61, the retaining portion R prevents the projection P from slipping out of the female fastener B. The engagement means 60 is provided with a manipulation lobe 62*a* on its portion 62 made of a non-magnetic or weakly magnetic material, in order to allow the engagement means 60 to be movable in the direction in which the engagement of the means 60 with the male fastener A is released.

(1) Fastening structure according to the first embodiment

FIGS. 1 through 7 show a first embodiment fastener means. FIG. 1 is an exploded view to show the component parts of the male fastener A (referred to as the male fastener A-1) and of the female fastener (referred to as the female fastener B-1 according to the first embodiment. The male and female members A and B respectively will be described in more detail. The male and the female fasteners A-1 and B-1 respectively will be described separately.

The male fastener A-1 according to the first embodiment is fixed to the first object 110 (referred to as the first object 110A in this embodiment). The female fastener B-1 is attached to the second object 120 which is moved in the direction opposing to said first object 110 (referred to as the second object 120A).

The male fastener A-1 comprises a main body 10, a permanent magnet M (referred to as the permanent magnet 20 in this embodiment) to be incorporated in the body 10, a ferromagnetic strip 21, a fixing leg member 30 (referred to as fixing leg member 30A) and a washer 40.

The main male body 10 includes a substantially square-shaped base 12, a box-like projected portion 11 which projects from the base 12 but is integrally formed therewith and functions as the projection P of the male fastener A-1. The base 12 has a dent 13 on its bottom and the periphery of the dent 13 constitutes the peripheral side wall 14.

Protrusions 15 for fixing said fixing leg member 30 are provided in the dented portion 13 at the bottom of the base 12. A blind hole 16 is also provided in the dent 13 extending toward the projected portion 11 to house the permanent magnet 20. The hole 16 has a notched portion 16*a* on its peripheral wall, particularly on the side of the projected portion 11 to which the engagement means 60 is attracted. Said ferromagnetic strip is to be fitted in this notched portion 16*a*.

The projected portion 11 on the main male body 10 is provided at its top with a ridge 17 extending along its length, and the bottom face 17*a* of the ridge 17 facing the base of the projected portion 11 functions as the engagement surface 17*a*. The engagement surface 17*a* acts as the retaining portion R for the engagement means 60 of the female fastener B-1.

A tapered or curved guide surface S is also provided at the top of the projected portion 11 to allow the projected portion 11 to effectively slip into the female fastener B-1, or more particularly to an opening 80 provided on the engagement means 60. The tapered or curved guide surface S should be so constructed that it contacts the opening edge 80*a* on the attraction side of the engagement means 60 when the engagement means 60 is moved as much as possible to the side where it is to be attracted to the projected portion 11. The shape and inclination or the curvature of the guide surface S may be arbitrarily determined so long as it satisfies these construction requirements. For example, the surface S may extend over the entire top surface of the projected portion 11 from one edge toward the other.

It is noted that a stepped portion 18 facing said ridge 17 is provided at the base of the projected portion 11, so that a grooved portion 19 is formed in between the ridge 17 and the stepped portion 18 to receive the engagement means 60. The grooved portion 19 is provided with a window-like through-hole 19*a* that communicates with said hole 16 via the notched portion 16*a*. In this way, the ferromagnetic strip 21 fitted in the notched portion 16*a* would be exposed via the through-hole 19*a* in the grooved portion 19.

As the stepped portion 18 extends from the base of the projected portion 11 laterally to create the grooved portion 19 which is fit for receiving the engagement means 60 and as the projected portion 11 to be inserted in the female fastener B-1 is tapered at the tip end while the its base is made wider, insertion of the projected portion 11 into the female fastener B-1 is facilitated. This construction also allows the projected portion 11 to be fitted relatively snugly in the female fastener B-1 at its base.

The fixing leg member 30A is dented at 31*a* to receive the bottom of the permanent magnet 20, and further includes a substantially square-shaped washer 31 having apertures 32, 32 which are bored on wings 31*b*, 31*b* disposed on both sides of the dented portion 31*a* to receive said protrusions 15 and a pair of leg strips 33 that are bent substantially at 90 degrees from the sides of the dented portion 31*a*. The washer 31 is housed inside said dented portion 13 of the male fastener 10.

The washer 40 is attached to the first object 110A to which the male fastener A-1 is fixed, particularly on the side where the male fastener A-1 is not fixed. It is provided with elongated openings 41, into which the legs 33 of said leg member 30A are inserted.

With the male fastener A-1 of the above construction, the permanent magnet 20 is fitted into the hole 16 and the ferromagnetic strip 21 is fitted in the notched portion 16*a* of the main body 10 respectively. At the same time, the bottom of the permanent magnet 20 is fitted in the dented portion 31*a* of the member 30A and the washer 31 of the member 30A in the bottom dent 13 of the main body 10. The protrusions 15 extending through the apertures 32 of the washer 31 are buckled to anchor the leg member 30A to the main body 10.

In the male fastener A-1 thus assembled, the permanent magnet 20 and the ferromagnetic strip 21 are firmly retained inside the blind hole 16 and the notched portion 16*a* of the main body 10 by means of the washer 31. As one of the faces of the ferromagnetic strip 21 is exposed through the through-hole 19*a* bored in said grooved portion 19, being substantially flush with the outer surface of the latter, the ferromagnetic portion 61 of the engagement means 60 of the female fastener B-1 can be directly in contact with the ferromagnetic strip 21.

As the legs 33 of the fixing leg member 30A are inserted from one side of the first object 110A toward the other and the washer 40 is fitted over the legs 33 where they protrude from said other side of the object 110A, the male fastener A-1 is firmly attached to the first object 110A as the legs 33 are bent over the washer 40.

Figure 4:
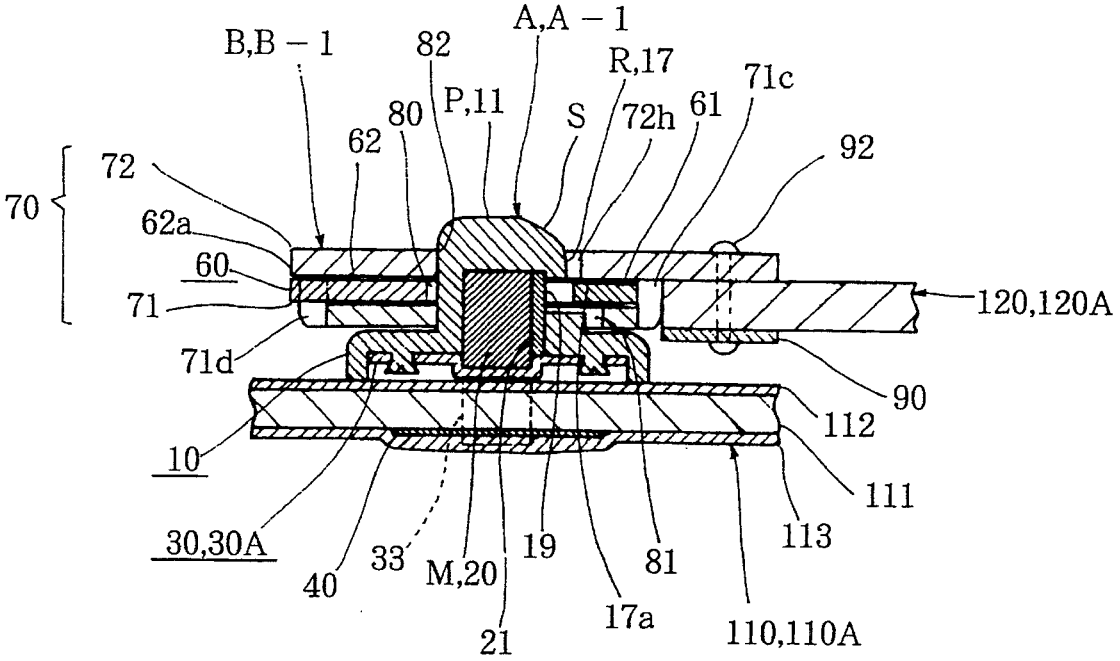
Figure 5:
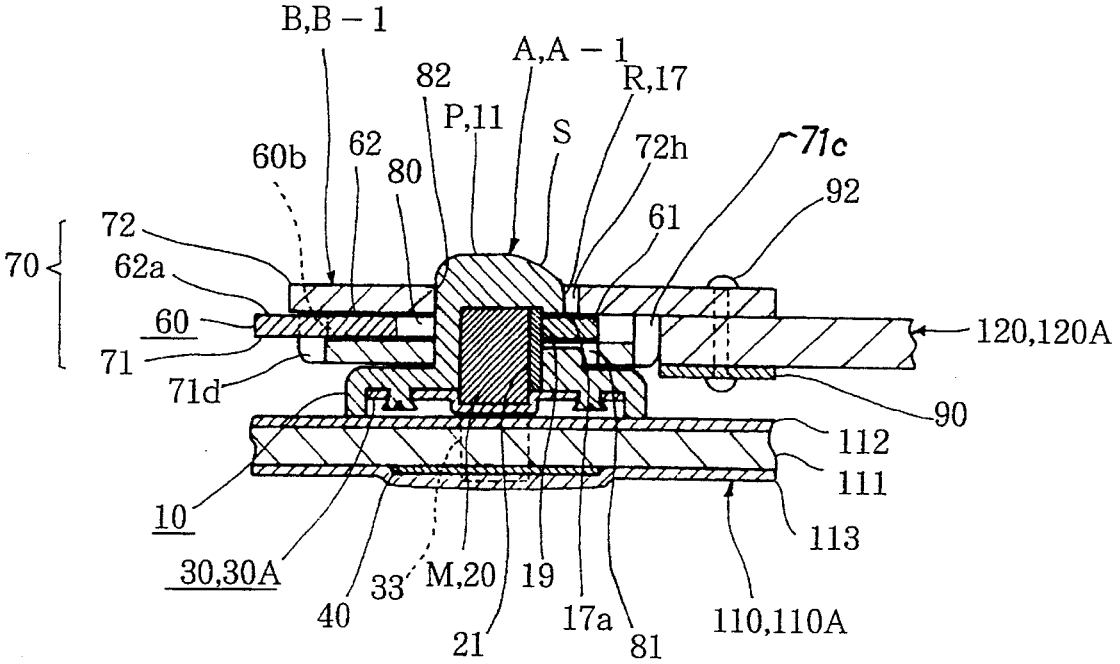

In this embodiment, the male fastener A-1 is attached to the first object 110*a* in such a manner that its side where the ridge 17 that functions as the retaining portion R is provided faces the opposite direction from the side edge of the second object 120, as shown in FIGS. 4 and 5.

It should be noted that the first object 110A may, for example, be the main body of a handbag, which comprises a cardboard 111 covered with a finishing material 112 such as leather and a lining material 113 to conceal the washer 40 and the legs 33 bent over the washer 40.

The main male body 10 according to the above mentioned example is typically made of a non-magnetic material such as die-cast aluminum; however, any material such as brass and plastic may also be used. The material may be weakly magnetic or even ferromagnetic depending on the cases.

The fixing leg member 30A is preferably made of a non-magnetic or weakly magnetic material so that the back face of the object 110A will not be magnetized by the permanent magnet 20. This also prevents the fixing leg member 30A from causing a short circuit between the magnetic poles of the permanent magnet 20 if the magnet 20 is magnetized on the right and the left sides as viewed in FIG. 4. It should be noted that the fixing leg member 30A is preferably made of a metal, so that its legs 33 can be bent to hold the male fastener A-1 firmly fixed to the first object 110A.

Typically, the washer 40 is preferably made of a non-magnetic material. If the fixing leg member 30A and the washer 40 are made of non-magnetic material, magnetic leakage from the permanent magnet 20 in the male fastener A-1 toward the back face of the first object 110A can be prevented.

On the other hand, it is possible to use a ferromagnetic material to construct the washer 40, and to attach the washer to the back face of the first object 110A in order to shield the permanent magnet 20 against magnetic leakage by the washer 40 and avoid inconveniences caused by the magnetic leakage from the male fastener A-1 toward the back face of the first object 110A.

The permanent magnet 20 incorporated in the main male body 10 may be of any material or shape so long as it attracts the ferromagnetic portion 61 of the engagement means 60 in the female fastener B-1, such as Ba-ferrite magnet, alnico magnet, and rare-earth magnet. For the same reason, there is no requirement regarding the direction of its magnetic poles. In case the ferromagnetic strip 21 is attached to the permanent magnet 20, the magnet 20 is preferably fitted in the main male body 10 in such a way that the side on which the strip 21 is attached has the opposite polarity to that on the opposite side.

In this embodiment, the ferromagnetic strip 21 acting as the pole strip of the permanent magnet 20 partially conceals the magnet 20 on one of the polar surfaces. As the magnetic flux is generated from the magnet 20 toward the outside, the ferromagnetic portion 61 in the engagement means 60 of the female fastener B-1 is attracted to the magnet 20. According to this embodiment construction, the ferromagnetic portion 61 of the engagement means 60 directly contacts said ferromagnetic strip 21 to assure stable attraction between the ferromagnetic portion 61 and the projection P of the male fastener A-1.

The female fastener B-1 of the first embodiment will now be explained. The female fastener B-1 comprises an engagement means 60, a main female body 70 into which the engagement means 60 is slidably incorporated, and a washer 90 for attachment. The main female body 70 includes a first plate-like housing member 71 and a second plate-like housing member 72 which is attached opposingly to the first housing member 71. By assembling the first and the second housing members 71 and 72, a space is created where said plate-like engagement means 60 slides in/out and an opening where the projection P of the male fastener A-1 is inserted.

The first housing member 71 comprises a substantially square-shaped plate member 71*a* and notches 71*b* provided on two opposite sides of the plate member 71*a* to receive catches 72*c* of the second housing 72 to be described below. Catches 71*c*, 71*c* and 71*d*, 71*d* are provided on the two opposing sides of the plate member 71*a* where said notches 71*b* are absent, the catches extending toward the second housing member 72 to be described. The plate member 71*a* further includes an opening 81 to receive the projection P of the male fastener A-1 at its base. It is preferable that when the first and the second housing members 71 and 72 are assembled with the catches 71*c* and 72*d* abutting against the latter member 72, the engagement means 60 can be snugly and slidably fitted in between the two members.

The second housing member 72 of the main female body 70 will be explained. The second housing member 72 includes a portion 72*a* that constitutes, together with the first housing member 71, the square-shaped main body 70 and a portion 72*f* that extends integrally from the portion 72*a*. Side strips 72*b*, 72*b* extend from the two opposing sides of the portion 72*a*, and catches 72*c* further extend from the side strips 72*b* in the downward direction. The side strips 72*b* includes side faces 72*d* and 72*e* which abut against the catches 71*c* and 71*d* respectively of the first housing member 71. Apertures 72*g* are bored on the plate portion 72*f*.

The catches 71*c* and 71*d* of the first housing member 71 are respectively abutted against the faces 72*d* and 72*e* of the second housing member 72, and the catches 72*c* are snugly fitted in the notches 71*b* of the first housing member 71, to thereby firmly assemble the first and the second housing members 71 and 72 respectively.

An opening 82 is provided on the second housing member 72 so that the tip end of the projection P of the male fastener A-1 can penetrate therethrough or rest therein via the housing member 71 and the engagement means 60 of the main female body 70. One of the peripheral edges 82*a* of the opening 82 (on the side where retaining portion R of the male fastener A-1 is provided) is indented on both ends to form stepped portions 72*h*, so that the projection P can be inserted and snugly fitted in the opening 82 without play and that the portion of the projection P that attracts the engagement means 60 can be disposed as far away as possible from the peripheral edge 82*a*.

As a result, the projection P of the male fastener A-1 rests against the peripheral edge 82*b* of the opening 82 on one side and against the stepped portions 72*h* on the other. The top end of the projection P snugly fits in between the peripheral edge 82*b* and the stepped portions 72*h* substantially without play. At the same time, the retaining portion R of the projection P is separated from the peripheral edge 82*a* for the width of the stepped portions 72*h*.

One of the characteristic advantages of this construction lies in that the magnetic force, particularly the force of the permanent magnet 20 to attract the ferromagnetic portion 61 of the engagement means 60, can be prevented from decreasing when the second housing member 72 is made of a ferromagnetic material.

The catches 71*c* provided on one side of the plate member 71*a* rest against the side of the strips 72*b* of the second housing member 72 when assembled. At the same time, the edge 60*a* of the engagement means 60 to be inserted in the main female body 70 when assembled also abuts against the catches 71*c*, the catches 71*c* being disposed at both ends of one of the sides of the plate member 71*a*.

The catches 71*d* provided on the side opposite the side where the catches 71*c* are provided abut against the portion 62 of the engagement means 60 made of a non-magnetic or weakly magnetic material. The catches 71*d* are preferably so disposed that the manipulation lobe 62*a* of the engagement means 60 can project through them without play.

The engagement means 60 to be fitted in the space formed by the first and the second housing members 71 and 72 is shaped like a plate having an opening 80, through which the projection P of the male fastener A-1 is inserted. The means 60 includes a rectangular ferromagnetic portion 61 and a U-shaped portion 62 made of a non-magnetic material, the portion 62 having a plate-like portion 62*c* and elongated areas 62*b*, 62*b* extending from the portion 62*c* to connect with the portion 61, to thereby define the substantially rectangular opening 80. The portion 62 made of a non-magnetic or weakly magnetic material is provided with the manipulation lobe 62 extending from the portion 62*c* with a width slightly narrower than that of the portion 62*c*, whereby shoulders 66*b* against which the catches 71*d* rest are formed.

The opening 80 of the engagement means 60 is substantially the same or slightly larger than the openings 81 and 82 provided on the first and the second housing members 71 and 72 respectively, to allow insertion of the projection P of the male fastener A-1. The ferromagnetic portion 61, the plate-like portion 62*c* and the rest of the portions constituting the means 60 have such dimensions that the engagement means 60 can be smoothly inserted in between the side strips 72*b*, 72*b* and snugly fitted in the space of a height defined by said side strips 72*b*. The length of the engagement means 60 in the direction of its movement, or the length between the edge 60*a* and the edge of the shoulder 60*b* at the end of the portion 62*c* is approximately the same with width defined by the catches 71*c* and 71*d* minus the distance the engagement means 60 moves as it is attracted toward-the male fastener A-1.

Figure 3:
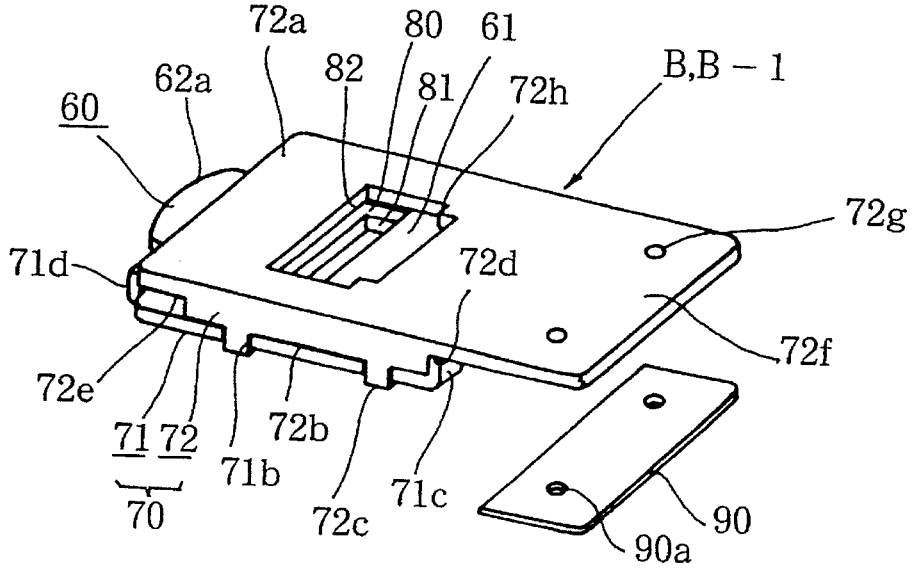

The engagement means 60 of the above construction is inserted between the first and the second housing members 71 and 72 in such a manner that the lobe 62*a* extends outwardly and the openings 80, 81 and 82 are aligned and communicated. The first and the second housing members 71 and 72 are firmly attached as the catches 72*c* are bent or caulked over the first housing member 71, whereby the main body of the female fastener B-1 is assembled as shown in FIG. 3.

The male and the female fasteners A-1 and B-1 are respectively so constructed that when the projected portion 11 of the male fastener that acts as the projection P is inserted in the openings 80, 81 and 82 of the female fastener B-1, the base plate 12 that acts as the main body of the male fastener A-1 becomes disposed in contact with or close to the female fastener B-1. Also, when the engagement means 60 of the female fastener B-1 is engaged with the projected portion 11 of the male fastener A-1 as the latter is inserted in the former, the tip of the projected portion 11 acting as the projection P protrudes outwardly from the female fastener B-1.

The fixing washer 90 will now be explained. The washer 90 in this embodiment is shaped substantially like a flat plate to correspond with the shape of the portion 72*f* of the second housing member 72 and is provided with apertures 90*a* a to correspond with the apertures 72*g* provided on the portion 72*f*.

The female fastener B-1 is then attached to one end of the second object 120A. The female fastener B-1 may be typically attached to the object 120A by, as shown in FIGS. 4 and 5, attaching the portion 72*f* to one of the end surfaces of the second object 120A, placing the washer 90 on the other end surface of the second object 120A, inserting a pin 92 with a head into each of the apertures 72*g* and 90*a*, and then by crushing the heads of the pins 92.

When attached, the female fastener B-1 is attached on the second object 120A with its lobe 62*a* disposed on the virtual line extending outwardly from the second object 120A. In this way the ridge 17 of the projected portion 11 of the male fastener A-1 attached to the first object 110*a* is disposed on the side opposite to the side where the lobe 62*a* is extending.

In the main female body 70 of the above construction, the first and the second housing members 71 and 72 may be made of a ferromagnetic material. By doing so, the female fastener B-1 can be strongly attracted by the male fastener A-1. This construction also prevents magnetic leakage from the male fastener A-1.

It is also possible to use a ferromagnetic material for either one of the housing members 71 or 72 and a non-magnetic material for the other. For example, when the first housing member 71 is made of a ferromagnetic material and the second housing member 72 a non-magnetic material, attraction of the female fastener B-1 by the male fastener A-1 is improved and the engagement means 60 can be easily subject to magnetism. Alternatively, when the first housing member 71 is made of a non-magnetic material and the second housing member 72 a ferromagnetic material, excellent magnetic attraction characteristic of the female fastener can be obtained and magnetic leakage in the assembled male and female fasteners can be reduced.

Further, when the housing members 71 and 72 are both made of a non-magnetic material, attraction of the engagement means 60 at the time the projection P is inserted can be enhanced.

The main female body 70 of the above construction can be made of any type of metal having ferromagnetic, non-magnetic or weakly magnetic property. Alternatively, it can be made of any material such as plastics and ceramics. The washer 90 and the pin 92 can also be made of any metal having ferromagnetic, non-magnetic or weakly magnetic property, similarly as in the case of the fixing leg member 30A and the washer 40 for attaching the male fastener A-1. Plastics and ceramics may also be used.

The female fastener B-1 of the above construction need not comprise the first and the second housing members 71 and 72 as described above but may be of any construction so long as the engagement means 60 can be slidably retained inside the female fastener B-1. For example, it may be structured as a flattened cylinder. Many other modifications and variations are possible with respect to its shape and structure.

The fixing leg member 30 may be of any material or structure so long as it can fix the male fastener A-1 to the object 110A; for example, it may be a bolt or a pipe that can be caulked. Further, the member 30 may be attached to the male fastener A-1 by any means suitable for its structure, such as by caulking, welding, soldering, or using adhesive or bolts and nuts.

The female fastener B-1 may be fixed to the second object 120A by any suitable means other than said washer 90. A fixing leg member similar to the member 30A which is used to fix the male fastener A-1 can also be used.

The most representative positional relation between the openings 80, 81 and 82 of the female fastener B-1 with the projection P of the male fastener A-1 will now be described referring to FIGS. 4 through 7.

Figure 6:
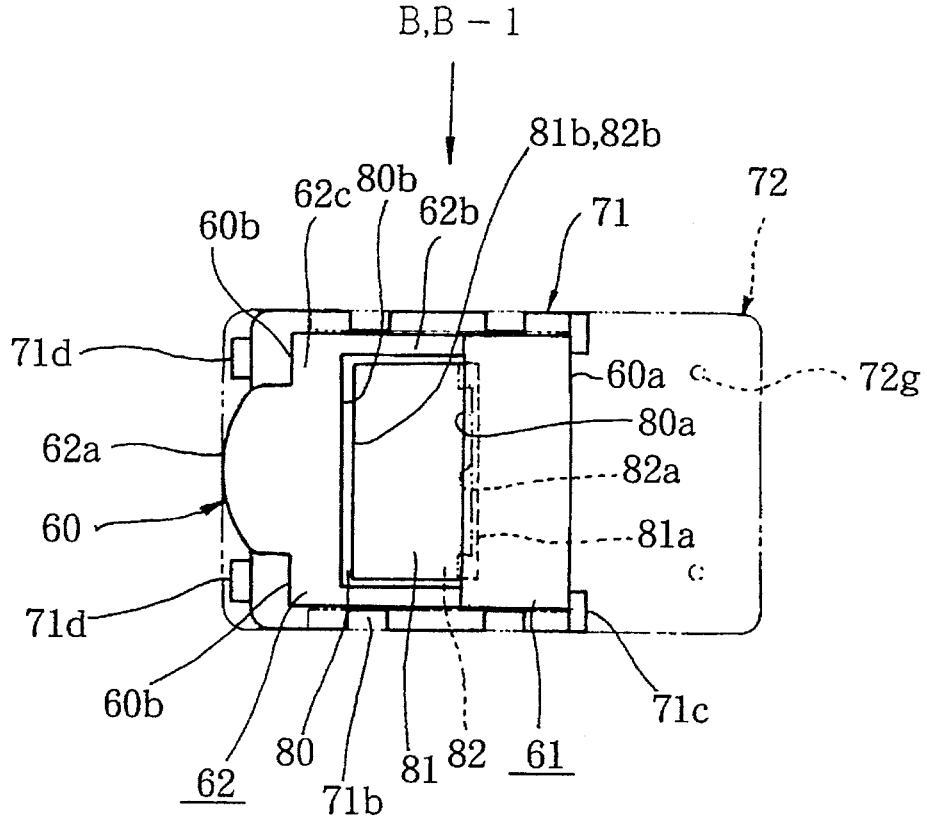
Figure 7:
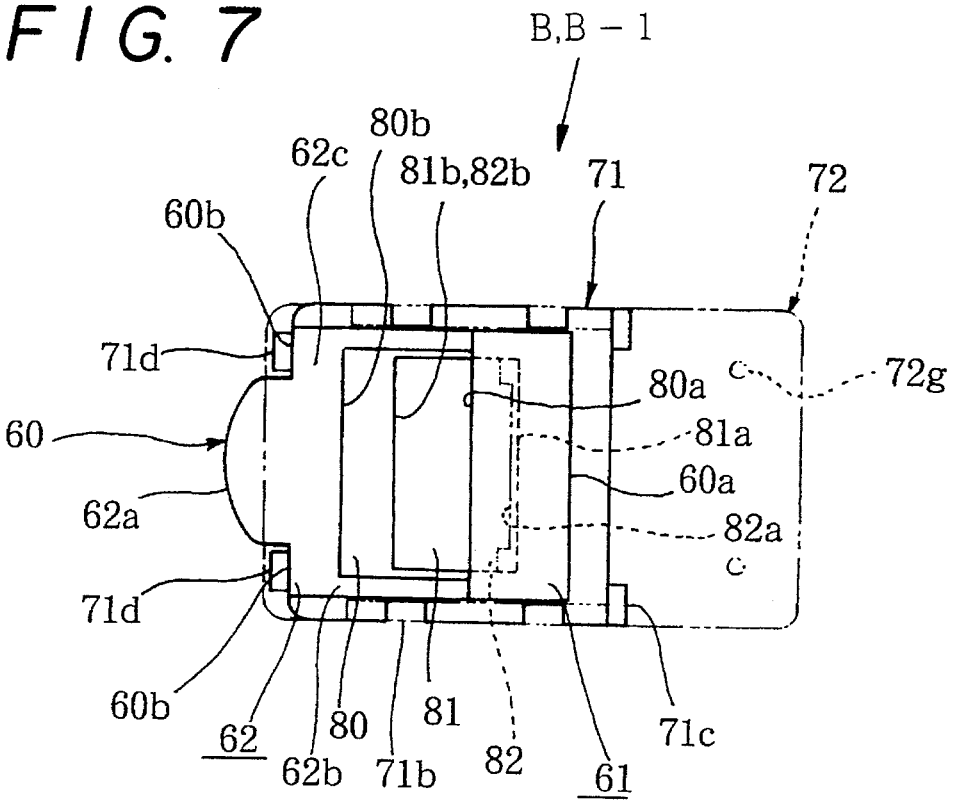

FIG. 4 shows the state where the male fastener A-1 is inserted in the female fastener B-1 but the engagement means 60 is not yet attracted by the male fastener A-1. It also shows the state where the engagement means 60 is press fitted, resisting against the attraction force of the permanent magnet 20 in the male fastener A-1. FIG. 6 shows the operational position of the engagement means 60 under such a state. FIG. 5 shows the state where the ferromagnetic portion 61 of the engagement means 60 in the female fastener B-1 is attracted to the male fastener A-1 while the means 60 is in engagement with the retaining portion R. FIG. 7 shows the operational position of the retaining portion 60 in the female fastener B-1.

As shown in FIGS. 4 and 5, the female fastener B-1 is first attached to the object 120A in such a way that the lobe 62*a* is disposed on the side edge of the second object 120A, with the side opposite to the lobe 62*a* facing the retaining portion R of the projection P. The female fastener B-1 is attached at a position that would allow the projection P of the male member A-1 to be easily inserted in the openings on the female fastener B-1.

The ridge 17 which functions as the retaining portion R on the projected portion 11 is so positioned that when the male fastener A-1 is inserted in the female fastener B-1, the portion R at least passes through the opening 80 in the engagement means 60. As the portion R passes through the opening 80, the ferromagnetic portion 61 of the engagement means 60 may be attracted to slide into the grooved portion 19. The grooved portion 19 has such a depth as to allow sliding of the portion 61 therein with allowance.

The positional relation of the first and the second housing members 71, 72 and the openings 80, 81, 82 of the engagement means 60 will now be explained. It is preferable that widths of the openings 80, 81 and 82 are optimally determined considering the ease of insertion/removal of the projected portion 11, stability of insertion and magnetic attraction characteristic of the engagement means 60.

The openings 81 and 82 of the first and the second housing members 71 and 72 respectively have the same opening width (in the vertical direction in FIGS. 6 and 7). By doing so, the movement of the projected portion 11 in this direction is restricted to a given range at the upper portion and the base of the projected portion 11. The opening width of the engagement means 60 in said direction is made greater than that of the openings 81 and 82, so as not to obstruct the movement of the engagement means 60 by the projected portion 11 inserted therein.

The widths of the openings 80, 81, 82 in the direction of the movement of the engagement means 60 (in the horizontal direction in FIGS. 4 through 7) will be explained. The respective opening edges 81*b* and 82*b* of the openings 81 and 82 respectively which come in contact with the back of the projected portion 11, or the side of the projected portion where the ridge 17 is not provided (on the left side of the projected portion 11 in FIGS. 4 and 5), are substantially aligned. The width defined by the edge 81*a* where it comes in contact with the ridge 17 and the edge 81*b* is set greater than that between the edges 82*a* and 82*b* in order to facilitate smooth insertion of the projected portion 11 in the female fastener B-1.

The top of the projected portion 11 has a width (the size in the horizontal direction in FIGS. 4 and 5) that allows it to be retained without play in the opening 82 by the edge 82*b* on one side and by the stepped portions 72*h*. A platform 18 is provided at the base of the portion 11 to extend width-wise farther than the projected portion 17 so that the platform 18 snugly fits in the opening 81 to assure firm engagement of the male and the female fasteners.

The opening 80 of the engagement means 60 is so constructed that the projected portion 11 can slip through the edge 80*a* when the portion 11 of the male fastener A-1 is inserted. When the engagement means 60 is pressed into the main female body 70, the edge 80*a* of the opening 80 in the ferromagnetic member 61 is situated slightly on the inner side (nearer toward the projected portion 11 in FIG. 4) than the edge 82*a* of the opening 82 of the second housing member 72. The edge 80*b* on the non-magnetic or weakly magnetic portion 62 which is opposite the edge 80*a* comes to be situated slightly on the outer side, or slightly farther away from the portion 11, than the edges 81*b* and 82*b* of the openings 81 and 82 respectively when the engagement means 60 is press fitted in the main female body 70.

Insertion and engagement of the projection P into the female fastener B-1 will now be explained in terms of the direction of movement of the engagement means 60.

The portion 11 which is the projection P of the male fastener A-1 is inserted in the opening 80 in the engagement means 60 of the female fastener B-1. The engagement means 60 is pulled into the main female body 70 attracted by the ridge 17 of the portion 11. The innermost edge 60*a* without the lobe 62*a* for manipulating the engagement means 60 abuts against or comes closer to the catches 71*c* in the first housing member 71.

As the ridge 17 of the portion 11 passes through the opening edge 80*a* of the engagement means 60, the edge 80*a* is attracted into the grooved portion 19 of the portion 11 by virtue of the permanent magnet 20. The shoulders 60*b* of the engagement means 60 thereby abut against or come closer to the catches 71*d* of the first housing member 71.

The openings 80, 81 and 82 are thus communicated to receive the portion 11 of the male fastener A-1. When the projected portion 11 is inserted into the opening 81 with its ridge 17 pressing against the opening edge 81*a*, the guide surface S at the tip of the portion 11 on the side of the ridge 17 abuts against the edge 80*a* in the engagement means 60 when the means 60 is in the state as shown in FIG. 5, namely, when the engagement means 60 is drawn in the direction of its removal from the female fastener B-1 by being pulled at the manipulation lobe 62*a*. There is also formed a small gap between the portion 11 and the opening edge 80*b* into which the portion 11 is to be inserted. Consequently, when the portion 11 is inserted in the female fastener B-1, its guide surface S abuts against the edge 80*a* to cause the engagement means 60 to slide into the female fastener B-1. As the ridge 17 provided on the side where the guide surface S is located passes the edge 80*a*, the opening edge 80*a* of the ferromagnetic portion 61 is attracted by the permanent magnet 20 provided at the portion 11 to thereby attract and retain the edge 80*a* of the engagement means 60 at the bottom of the ridge 17.

As the projected portion 11 which is the projection P of the male fastener A-1 is inserted in the female fastener B-1 of the above construction, the engagement means 60 is pulled back toward the inside of the main female body 70, and the opening edge 80*a* on the ferromagnetic portion 61 of the engagement means 60 is attracted by the permanent magnet 20 where the ridge 17 of the portion 11 has passed through opening 80 to thereby move the engagement means 60 in the direction shown in FIG. 5. The opening edge 80*a* is thus attracted by the lower surface (in this case, the grooved portion 19) of the portion 11 beneath the ridge 17. The male and female fasteners are used in this state for fastening purposes. The engagement means 60 is, for example, pressed farther into the main female body 70 to release the engagement of the opening edge 80*a* with the ridge 17 of the projected portion 11, and the male and the female fasteners are pulled apart.

(2) Fastener means according to the second embodiment

Figure 8:
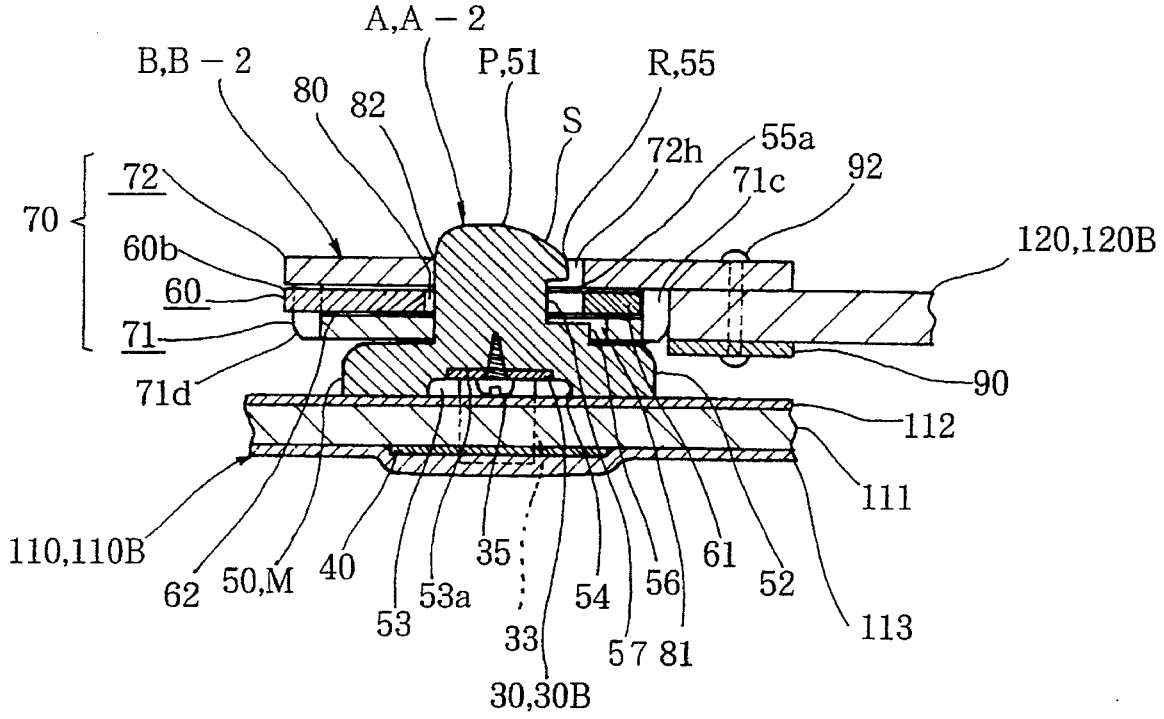
FIGS. 8 through 10 show the second embodiment fastener means.
Figure 9:
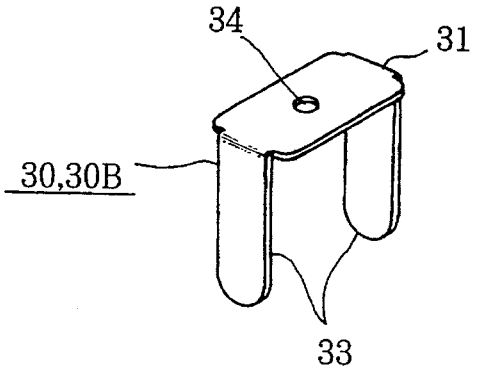
Figure 10:
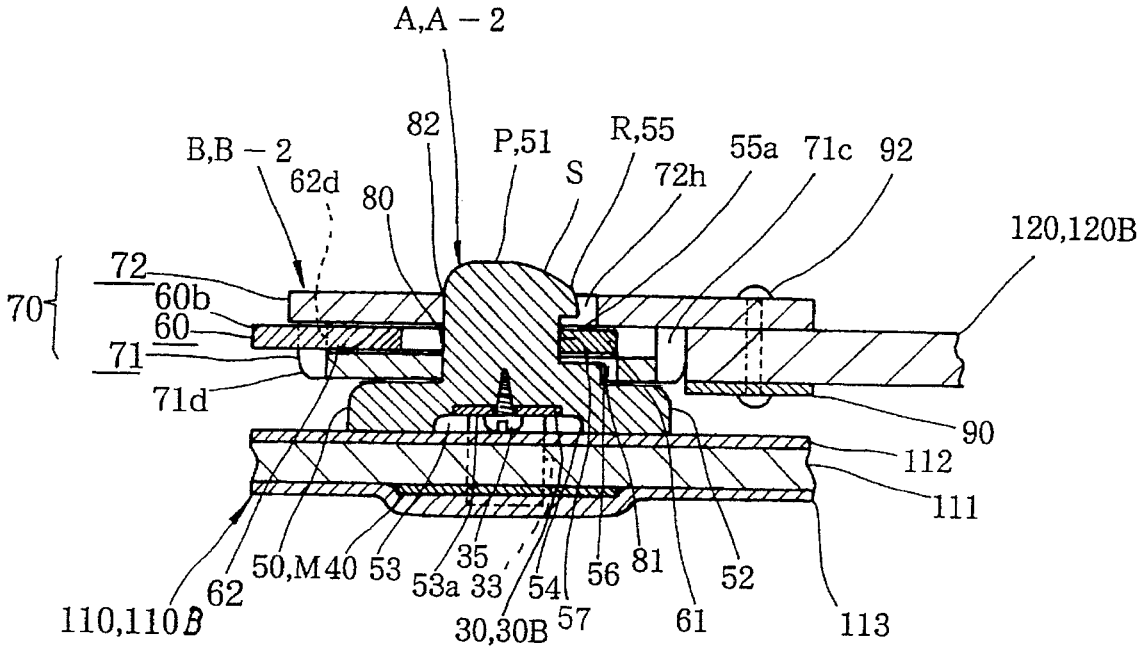

FIGS. 8 through 10 show the fastener means according to the second embodiment.

According to the second embodiment, the male fastener A-2 includes the main male body 50 having substantially the same shape as the main male body 10 of the male fastener A-1 of the first embodiment and comprising the permanent magnet 20 and the ferromagnetic strip 21. The male fastener A-2 is for example made of a plastic material which is mixed with Ba ferrite powder having hard magnetic characteristics and is treated for magnetization.

The main male body 50 includes a substantially square-shaped base 52 and a rectangular projected portion 51 integrally extending from the base 52 to function as the projection P of the male fastener A-2. A stepped bottom dent 53 is provided on the bottom of the base 52, which is defined by the wall 54.

The projected portion 51 of the main male body 50 is provided with a ridge 55 projecting outwardly from its side on the longitudinal direction at its top. The bottom face of the ridge 55 that faces the base of the projected portion 51 acts as the engagement face 55*a*, or as the retaining portion R to become engaged with the engagement means 60 of the female fastener B-2. A guide surface S which is tapered or curved downwardly toward the tip end of the ridge 55 is provided at the top edge of the portion 51, similarly as in the case of the male fastener A-1. At the base of the portion 51 is provided a platform 56 opposing the ridge 55. The engagement means 60, particularly its ferromagnetic portion 61, slips into a grooved portion 57 defined by the platform 56 and the ridge 55. As the platform 56 at the base of the portion 51 projects farther toward the sideway than the ridge 55, the portion 51 becomes thicker at the bottom while the tip end is made thinner, facilitating insertion of the portion 51 into the female fastener B-1. At the same time, the male fastener A-2 can be relatively firmly retained inside the female fastener A-2 by virtue of the thicker base portion of the portion 51.

According to this embodiment, the base 52 of the male fastener A-2 is so constructed that the top edge of the projected portion 51 projects outwardly from the female fastener B-2 when the base 52 is inserted in the female fastener B-2 and when the ridge 55 of the portion 51 is in engagement with the means 60 of the female fastener B-2.

The fixing leg member 30B includes a substantially rectangular seat plate 31 that tightly fits inside the fixing face 53*a* of the stepped bottom dent 53 and a pair of legs 33, 33 which are bent substantially at 90° from both sides of the seat plate 33. The fixing leg member 30B is affixed to base 52 by fitting the seat plate 31 against the face 53*a* of the dent 53 and by screwing the screws 35 into the main male body 50 via the apertures 34 provided in this seat plate 31. The construction of the embodiment is such that the head of the screw 35 is completely contained inside the dent 53.

It is noted that the shape and construction of the male fastener A-2 are substantially the same as the male fastener A-1 of the first embodiment except for those described above. Engagement and release of the male and the female fasteners can be achieved in substantially the same manner as described in respect of the first embodiment.

Except for the matters described above, the male and the female fasteners A-2 and B-2 respectively of the second embodiment are identical or substantially identical to the male and female fasteners according to the first embodiment. The same component parts are given the same reference numbers and their explanation is omitted.

The male fastener A-2 of the above construction is attached to the first object 110B in the same manner as in the first embodiment, and the female fastener B-2 to the second object 120B in the same manner as in the first embodiment.

(3) Variations of the engagement means 60

Other variations of the engagement means 60 used to fasten the female fastener B will now be explained.

Figure 11:
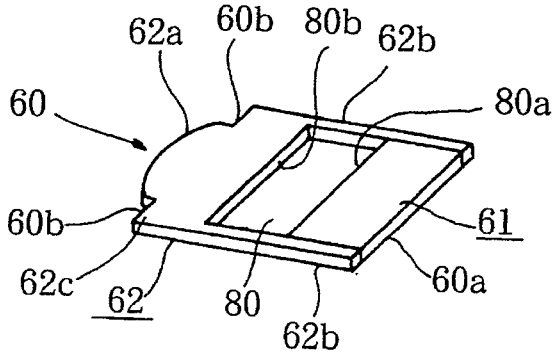
FIGS. 11 through 14 are perspective views to show other embodiments of the engagement means 60.

The engagement means 60 shown in FIG. 11 includes a plate-like ferromagnetic portion 61, two opposing strips 62*b*, 62*b* that extend integrally from the portion 61 to connect to the plate-like member 62*c*. A lobe 62*a* for manipulation is provided on the portion 62 which is made of a non-magnetic or weakly magnetic material, the lobe 62*a* having a width narrower than the plate-like member 62*c*. In the engagement means 60 shown in FIG. 11, the ferromagnetic portion 61 is interposed between the strips 62*b*, 62*b* to define the opening 80. Both ends of the plate-like portion 62*c* adjacent to the lobe 62*a* are formed as the shoulders 60*b* that abut against catches 71*d*. Opposite the shoulders 60*b* is the edge 62*a* that abuts against catches 71*c*.

Figure 12:
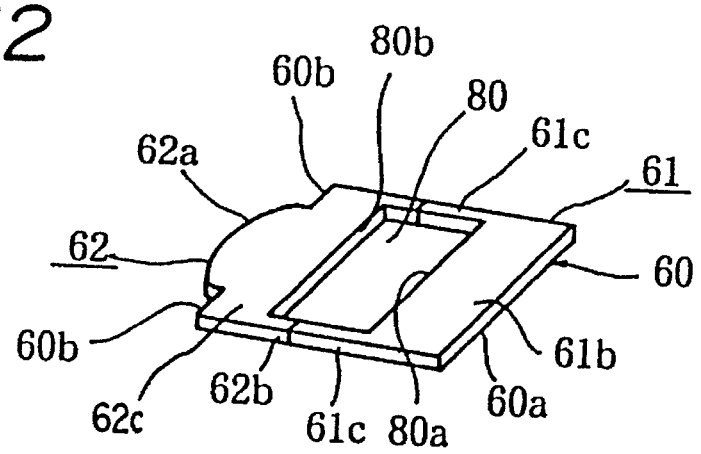

The engagement means 60 shown in FIG. 12 includes a plate-like portion 61*b* constituting the ferromagnetic portion 61, and a plate-like portion 62*c* which is made of a non-magnetic or weakly magnetic material. Strips 61*c*, 61*c* and strips 62*b*, 62*b* integrally extend toward each other from both ends of the plate-like ferromagnetic portion 61*b* and the plate-like portion 62*c* which is made of a non-magnetic or weakly magnetic material, to thereby define the opening 80 of the engagement means 60.

Figure 13:
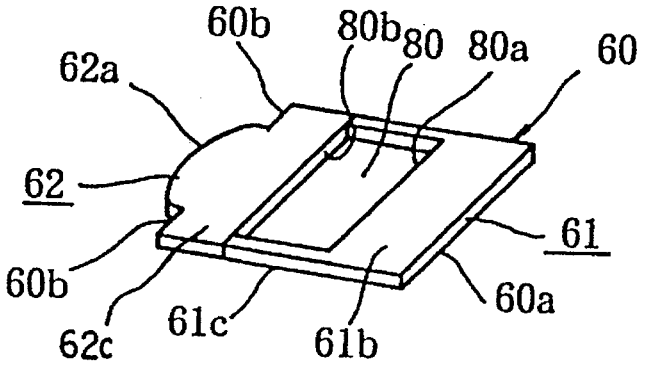

In the engagement means 60 shown in FIG. 13, the plate-like portion 62 made of a non-magnetic or weakly magnetic material includes a plate member 62*c* and a lobe 62*a* that extends therefrom. The ferromagnetic portion 61 includes the plate member 61*b* and a pair of strips 62*b* extending therefrom. By connecting the tip ends of the strips 62*b* to the plate member 62*c* integrally, the opening 80 of the engagement means 60 is defined.

Figure 14:
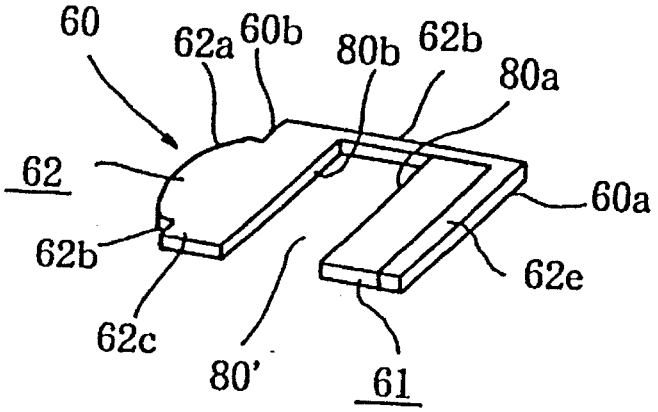

In the engagement means 60 shown in FIG. 14, the portion 62 made of a non-magnetic or weakly magnetic material includes a plate member 62*c*, an L-shaped member comprising a strip 62*b* and a retaining strip 62*e* that runs substantially parallel to the plate member 62*c* as it extends from the end of the strip 62*b*. The ferromagnetic member 61 is integrally attached to this L-shaped member comprising the strip 62*b* and the retaining strip 62*e*, to thereby define the opening 80' of the engagement means 60 where the projection P of the male fastener A is inserted.

It suffices that the engagement means 60 to be used in this embodiment comprises a ferromagnetic portion 61 which is attracted to the projection P of the male fastener A, and a portion which is made of a non-magnetic or weakly magnetic material and which is situated opposite to said ferromagnetic portion 61. The portions 61 and 62 may be connected in any manner. They may be connected using a separate member. The opening for receiving the projection P of the male fastener A need not be the opening shown so long as there is a space to insert the projection P.

It is noted that the engagement means 60 shown in FIGS. 11 through 14 is adapted to be used in the first and the second embodiments described above. The details of their construction other than those mentioned above are the same or substantially the same as those in the first embodiment and are given the same reference numbers. Their description is omitted.

The fastener means according to the present invention is characterized by the construction mentioned above, particularly by the construction of the female fastener member which includes the engagement means 60 comprising the ferromagnetic portion 61 and the portion which is made of a non-magnetic or weakly magnetic material, the ferromagnetic portion 61 being the portion to be attracted by and abutted against the male fastener A on the side provided with the retaining means R and the non-magnetic portion 62 being on the opposite side where the retaining means R is not provided. Consequently, even if the projection P of the male fastener A to be inserted in the engagement means 60 contacts or comes near to either side of the engagement means 60, said ferromagnetic portion 61 of the engagement means 60 can be conveniently attracted to the projection P. This feature enables the female fastener B to be made compact.

As the manipulation lobe 62*a* is provided on the non-magnetic portion 62 of the engagement means 60, magnetic leakage of the permanent magnet M on the male fastener A can be prevented. The manipulation lobe 62*a* can be constructed free of the magnetic circuit of the permanent magnet M.

What is claimed is:

1. A fastener comprising:

a male member including an upstanding projection having a magnet source;

a female member including a housing member and an engagement member slideably received within the housing member, said engagement member comprising a first portion which is ferromagnetic and a second portion which is non-ferromagnetic or weakly magnetic;

wherein the housing member and the engagement member define openings through which the upstanding projection is removably insertable, and wherein after the projection is inserted into the openings an attraction force between the magnet source and the first portion causes the first portion to slide toward the magnet source until the engagement member is in a locking relationship with the projection;

wherein the second portion inhibits magnetic leakage from said magnet source.

2. The fastener according to claim 1, further comprising a ridge disposed on the projection, said ridge positioned above the first member when the first portion is in the locking relationship with the projection, thus preventing the engagement member from separating away from the projection.

3. The fastener according to claim 2, further comprising a round surface formed on top of the projection to facilitate insertion of the projection.

4. The fastener according to claim 1, wherein the engagement means further comprises a manipulable portion such that when the first portion is in the locking relationship with the projection, the manipulable portion is exposed outside of the housing member such that if the manipulable portion is pushed back into the housing member the first portion and the projection are no longer in a locking relationship.

5. The fastener according to claim 1, wherein the housing member comprises a top plate and a bottom plate affixed to each other.

6. The fastener according to claim 1, wherein the magnet source is a permanent magnet disposed within the projection.

7. The fastener according to claim 1, wherein the magnet source is distributed throughout the projection.

* * * * *